United States Patent [19]

Martini

[11] 4,219,045

[45] Aug. 26, 1980

[54] SEA WATER PRESSURE REGULATOR VALVE

[75] Inventor: Leonard J. Martini, San Diego, Calif.

[73] Assignee: The United States of America as represented by the Secretary of the Navy, Washington, D.C.

[21] Appl. No.: 972,560

[22] Filed: Dec. 22, 1978

[51] Int. Cl.[3] ..... E01H 1/10

[52] U.S. Cl. ..... 137/899.2; 137/505.25; 220/208

[58] Field of Search ..... 177/505.25; 220/209, 220/208; 114/330, 333; 137/344

[56] References Cited

U.S. PATENT DOCUMENTS

| | | | |
|---|---|---|---|
| 1,525,426 | 2/1925 | Mueller | 137/505.18 |
| 2,845,946 | 8/1958 | Oliveau | 137/505.25 X |
| 3,104,641 | 9/1963 | Froehlick | 114/330 |
| 3,538,930 | 11/1970 | Kowalski | 137/505.25 X |
| 4,083,380 | 4/1978 | Huber | 137/505.25 |

*Primary Examiner*—Harold W. Weakley
*Attorney, Agent, or Firm*—Richard S. Sciascia; Ervin F. Johnston

[57] ABSTRACT

A sea water pressure regulator valve is provided for a fuel tank, the valve including an elongated body having a longitudinal cylindrical hole which opens into the fuel tank and a perpendicular passageway which is adapted to open the cylindrical hole to sea water. A piston is slidably mounted in the cylindrical hole with an O-ring on each side of the perpendicular passageway so as to render the movement of the piston independent of sea water pressure. The piston has a longitudinal passageway throughout its entire length so as to be open into the fuel tank at a downstream end and open into the bottom of the cylindrical hole at an upstream end. The piston has at least one aperture adjacent a perpendicular passageway for variably opening the pistons longitudinal passageway to sea water so that sea water will flow from the perpendicular passageway into the pistons longitudinal passageway and out the downstream end of the piston into the fuel tank. A spring biases a piston downstream to open the aperture with respect to the perpendicular passageway. With this arrangement the strength of the spring and the effective areas of the upstream and downstream ends of the piston will cause a predetermined pressure in the fuel tank as the fuel is used regardless of the pressure of the sea water.

7 Claims, 4 Drawing Figures

SEA WATER PRESSURE REGULATOR VALVE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Torpedoes which are operated by a liquid fuel require the fuel tank to be pressurized to a predetermined level so as to maintain a constant flow of fuel to a propulsion motor. The fuel tank in this type of torpedo is normally a section of the torpedo wherein the confines of the tank are defined by a cylindrical hull portion of the torpedo with a pair of spaced apart plate type bulkheads at fore and aft ends thereof. In the past a carbon dioxide pressure bottle has been utilized to supply the gas necessary to maintain the fuel tank at a predetermined pressure, normally between 100 to 180 psi. With this arrangement the carbon dioxide bottle takes up space within the torpedo. Further, it has been desirable to increase the internal fuel tank pressure to between 180 to 270 psi which would require even a larger $CO_2$ pressure bottle. While the tank could be directly open to ambient sea water this would result in unnecessarily high pressures within the tank, thus requiring significantly thicker bulkheads at each end of the tank to withstand the pressures involved.

SUMMARY OF THE INVENTION

The present invention provides a regulator valve which utilizes sea water as a pressure source for maintaining a desired internal fuel tank pressure with components to ensure that the pressure does not exceed 270 psi. With such an arrangement the space normally taken by a $CO_2$ bottle as a pressure source is saved and the fore and aft bulkheads of the fuel tank can be constructed merely to withstand the predetermined internal tank pressure. This has been accomplished by providing a pressure regulator valve which has an elongated body having a longitudinal cylindrical hole which opens into the fuel tank and a perpendicular passageway which is adapted to open the cylindrical hole to sea water. A piston is slidably mounted in the cylindrical hole with an O-ring on each side of the perpendicular passageway so as to render the movement of the piston independent of sea water pressure. The piston has a longitudinal passageway throughout its entire length so as to open into the fuel at a downstream end and open into the bottom of the cylindrical hole at an upstream end. The piston has at least one aperture adjacent the perpendicular passageway for opening or closing the piston's longitudinal passageway to sea water when the piston is moved to downstream or upstream locations in the cylindrical hole respectively, the sea water flowing from the perpendicular passageway into the pistons longitudinal passageway and out the downstream end of the piston into the fuel tank when the aperture is open. A device is provided for sealing the aperture from the perpendicular passageway when the aperture is closed off from the perpendicular passageway. A spring biases the piston downstream to open the aperture with respect to the perpendicular passageway. With this arrangement the strength of the spring and the effective areas of the upstream and downstream ends of the piston are such that a predetermined pressure is maintained in the fuel tank as fuel is used regardless of the pressure of the sea water.

OBJECTS OF THE INVENTION

An object of the present invention is to provide a fuel tank regulator valve which utilizes sea water as a pressure source to maintain a predetermined pressure within the fuel tank.

Another object is to provide an ambient fluid pressure regulator valve for a fuel tank which maintains the fuel tank at a predetermined internal pressure.

A further object is to provide a regulator valve for a fuel tank which takes up a minimum of space and minimizes the structural strength requirements of the fuel tank walls.

Still another object is to provide a regulator valve for a fuel tank which utilizes sea water as a source of pressure and which will completely seal the fuel tank from the source pressure when the fuel tank has reached a predetermined internal tank pressure.

Yet another object is to provide a pressure regulator valve which utilizes an ambient fluid as a pressure source and which has a minimum of moving parts.

These and other objects of the invention will become more readily apparent from the ensuing specification when taken together with the drawings.

DESCRIPTION OF THE PREFERRED EMBODIMENT

Figure 1:
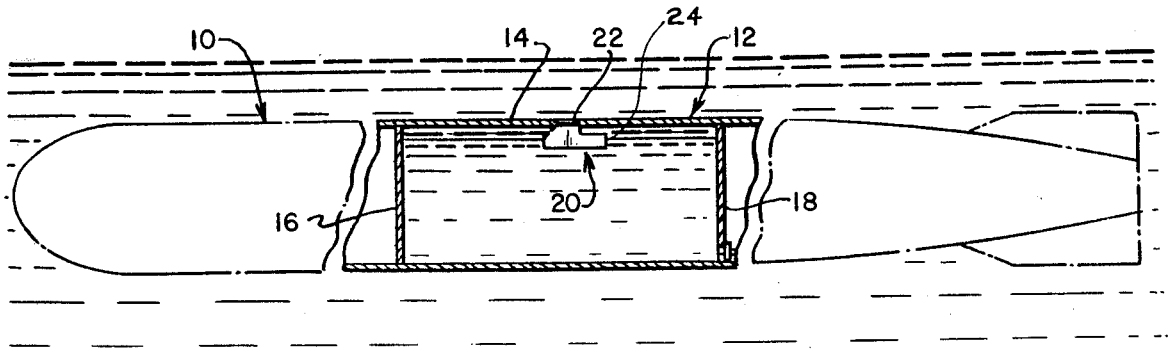
FIG. 1 is a side view of a torpedo with a central hull section broken away to illustrate a fuel tank with a pressure regulator valve shown in the top portion thereof.

Referring now to the drawing wherein like reference numerals designate like or similar parts throughout the several views there is illustrated in FIG. 1 a torpedo 10 which has a fuel tank 12. The fuel tank 12 is an intermediate section of the torpedo and is defined by the annular hull 14 of the torpedo as well as fore and aft plate like bulk heads 16 and 18 respectively. Located within the fuel tank 12 is a pressure regulator valve 20 which is open to sea water at a port 22 and opens into the fuel tank at a port 24. While the description will explain the pressure regulator valve 20 in relationship to a sea water pressure source, it is to be understood that the valve could be utilized with any ambient fluid pressure source for operation in connection with any fluid tank.

Figure 2:
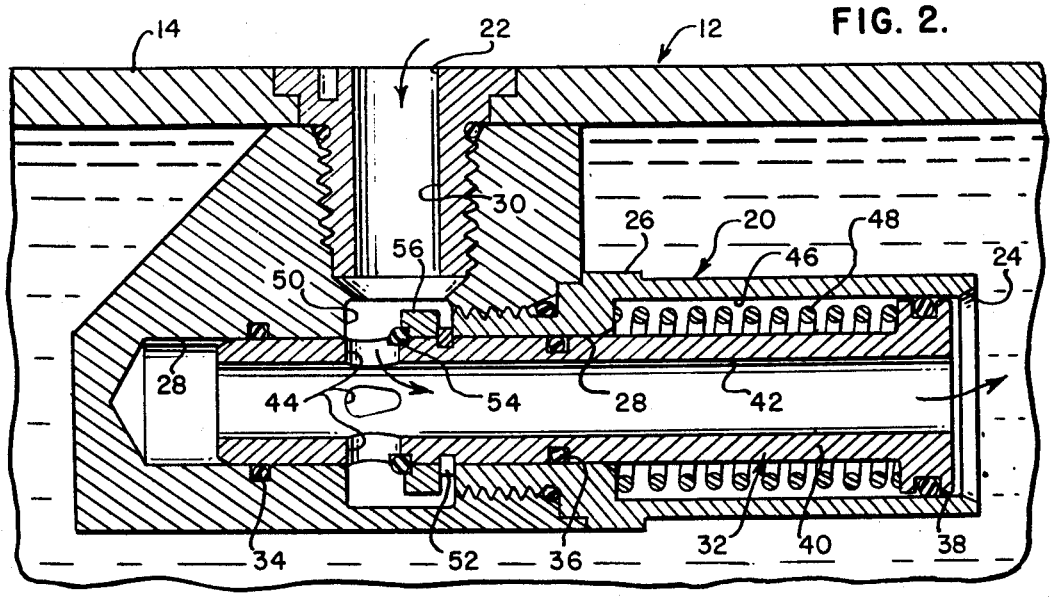
FIG. 2 is an enlarged cross-sectional view of the pressure regulator valve in a fully opened position.

As illustrated in FIG. 2 the pressure regulator valve 20 includes an elongated body 26 which has a longitudinal cylindrical hole 28 which opens into the fuel tank 12 at the port 24 and has a perpendicular passageway 30 which is adapted to open the cylindrical hole 28 to the sea water at port 22. Piston means 32 are slidably mounted in the cylindrical hole 28 with O-rings 34 and 36 on each side of the perpendicular passageway 30 so as to render the movement of the piston means independent of the sea water pressure. The O-ring 34 may be mounted within the cylindrical hole 28 and the O-ring 36 may be mounted in the piston means. The piston means 32 may include a hollow piston head 28 and a tubular piston rod 40. With this arrangement the piston means 32 has a longitudinal passageway 42 throughout its entire length so as to open into the fuel tank 12 at a downstream end and open into the bottom of the cylindrical hole at an upstream end.

Figure 3:
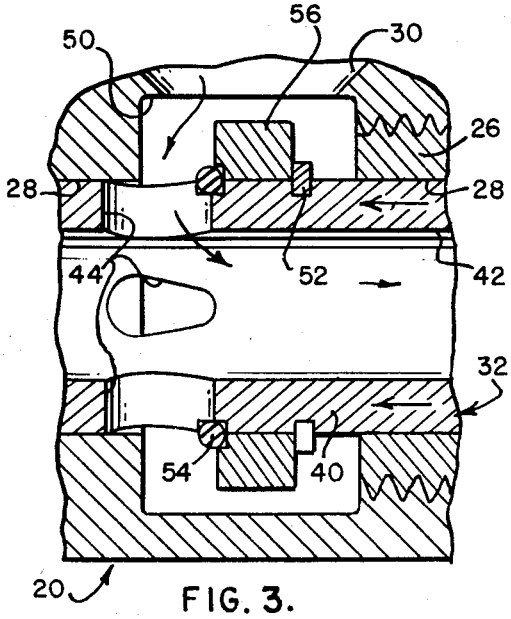
FIG. 3 is an enlarged portion of the regulator valve of FIG. 1 shown in a partially closed position.
Figure 4:
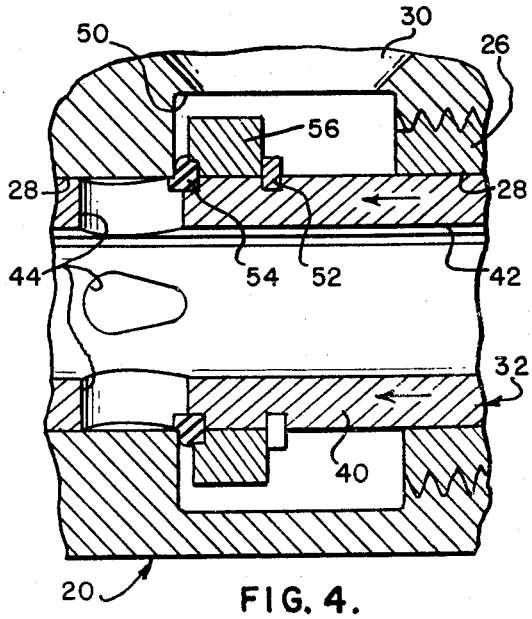
FIG. 4 is a view similar to FIG. 3 except the valve is shown in a completely closed and sealed position.

In the preferred embodiment the piston rod 40 is provided with a plurality of apertures 44 which are adjacent the perpendicular passageway 30 for opening or closing the piston means longitudinal passageway 42 to sea water when the piston means is moved to downstream or upstream locations in the cylindrical hole 28 respectively. These two extreme positions are illustrated in FIG. 2 and FIG. 4 respectively, an intermediate partially closed position being illustrated in FIG. 3. The apertures 44 enable sea water to flow from the perpendicular passageway 30 into the pistons longitudinal passageway 42, and out of the downstream end of the piston means into the fuel tank 12 for maintaining a predetermined pressure within the fuel tank. An example of the pressure required within the fuel tank is 270 psi. It is also desirable that the apertures 44 be pear shaped with the small end thereof being on the downstream side of the piston means 32. With this arrangement, the effective areas of the apertures 44 are exponentially closed off as the apertures progress from the fully opened position to the fully closed position.

Means are provided for biasing the piston means downstream to open the apertures 44 with respect to the perpendicular passageway 30. The biasing means may include the downstream portion of the cylindrical hole 28 being counterbored at 46 with a compression spring 48 disposed in the counterbore between the bottom of the counterbore and the bottom of the piston head 38.

As illustrated in FIG. 2, it is important that the upstream end of the piston rod 40 be spaced from the upstream end of the cylindrical hole 28 at a distance which is sufficient to cause the apertures 44 to close off the perpendicular passageway 30 to the longitudinal passageway 42 when the piston rod 40 is slid into such space. Further, it is necessary to stop the downstream movement of the piston means 32 when the apertures 44 are fully opened to the perpendicular passageway 30. This may be accomplished by providing a cylindrical hole 28 with an annular enlargement 50 adjacent the perpendicular passageway 30. Further, a retainer ring 52 may be mounted on the piston rod 40 within the annular enlargement 50 so as to engage a downstream end of the annular enlargement when the apertures 34 are fully opened to the perpendicular passageway 30.

It is highly important that a means be provided for sealing the apertures 44 from the perpendicular passageway 30 when the apertures 44 are closed off from the perpendicular passageway, as illustrated in FIG. 4. The importance of this sealing means is to ensure that the internal tank pressure does not exceed a predetermined value, such as 270 psi, when the sea pressure may be at extremely high values. This will enable the fore and aft bulkheads 16 and 18 of the fuel tank 12 to be designed for the predetermined internal tank pressure rather than withstanding the maximum sea pressures at which the torpedo may operate. The aperture sealing means may include an O-ring 54 which is mounted within the exterior of the piston rod 50 substantially coextensive with the downstream ends of the apertures 44. It should be noted that with this arrangement the retainer ring 52 is spaced a short distance upstream from the O-ring 54. In order to retain the O-ring 54 for an effective seal when the apertures 44 are closed, as illustrated in FIG. 4, it has been found desirable to provide a collar 56 which is mounted about the piston rod 44 between the retainer ring 52 and the O-ring 54. The collar 56 has an upstream notch for receiving the O-ring and maintaining it tightly in place for the required seal when it engages the upstream annular edge of the annular enlargement 50. In the preferred embodiment the effective area of the apertures 44 in the totally open positions will be equal to or greater than the exit area of the longitudinal passageway 42 so that sea water will quickly pressurize the fuel tank when the torpedo is launched into the ocean.

OPERATION OF THE INVENTION

In the operation of the invention the torpedo 10 is launched into the ocean. Sea water immediately enters the perpendicular passageway 30 and pressurizes the fuel within the tank 12 via the apertures 44 which are in a fully opened position, as illustrated in FIG. 1. As the internal fuel tank pressure approaches the predetermined pressure, such as 270 psi the apertures 44 are progressively closed, as illustrated in FIG. 3. When the tank has attained the predetermined pressure the apertures 44 are completely closed off and the O-ring 54 makes a complete seal between the sea water and the fuel tank, as illustrated in FIG. 4. As fuel is consumed from the fuel tank the apertures 44 will open slightly to allow the entrance of additional sea water under pressure to bring the internal fuel tank pressure back up to the predetermined value. It is of much interest how this operation is implemented. The exit pressure acting on the upstream end of the piston rod 40 in combination with the spring pressure 48 is counterbalanced by the exit pressure acting on the downstream end of the piston head 38. When the force on the piston head exceeds the forces due to the pressure acting on the upstream end of the piston rod 40 and the spring force 48 the apertures 44 are completely closed, as illustrated in FIG. 4. It should be noted that these forces act completely independently of ambient sea pressure since the O-rings 34 and 36 isolate the sea pressure from the effective areas of the piston ends. Of course, the regulation pressure in the fuel tank may be changed by simply inserting a spring 48 of a different strength. It should further be noted that in the operation of the present invention that the fuel tank pressure is regulated by simply the movement of the piston means 32.

It should now be readily apparent that the present invention provides a very simple fuel tank pressure regulation valve which can regulate the fuel tank pressure to a predetermined value by utilizing ambient pressure which may be at extremely high magnitudes. With such an arrangement a separate pressure source for regulating purposes is obviated and the internal bulk heads of the fuel tank can be designed simply for the predetermined fuel tank pressure. This enables additional space for fuel to be utilized for operating the torpedo.

Obviously, many modifications and variations of the present invention are possible in the light of the above teachings, and, it is therefore understood that within the scope of the disclosed inventive concept, the invention may be practiced otherwise than specifically described.

What is claimed is:

1. An ambient fluid pressure regulator valve for a fuel tank comprising:

an elongated body having a longitudinal cylindrical hole which opens into said fuel tank and a perpendicular passageway which is adapted to open the cylindrical hole to the ambient fluid;

piston means slidably mounted in the cylindrical hole with an O-ring on each side of the perpendicular passageway so as to render the movement of the piston independent of ambient fluid pressure;

said piston means having a longitudinal passageway throughout its entire length so as to open into the fuel tank at a downstream end and open into the bottom of the cylindrical hole at an upstream end;

said piston means having at least one aperture adjacent the perpendicular passageway for variably opening the piston means longitudinal passageway to the ambient fluid as the piston means slides in the cylindrical hole so that ambient fluid will flow from the perpendicular passageway into the piston means longitudinal passageway and out the downstream end of the piston means into the fuel tank;

means biasing the piston means downstream to open the aperture with respect to the perpendicular passageway;

the strength of the biasing means and the effective areas of the upstream and downstream ends of the piston means being such that the aperture is variably opened to maintain a predetermined pressure in the fuel tank as fuel is used regardless of the pressure of the ambient fluid after said predetermined pressure is reached in the fuel tank;

the upstream end of the piston means being spaced from the upstream end of the cylindrical hole a distance sufficient to cause the aperture to close off the perpendicular passageway to the longitudinal passageway when the piston means is slid into said space; and an O-ring which is mounted in the piston means substantially coextensive with the downstream end of the aperture for sealing the aperture from the perpendicular passageway when the aperture is closed off from said perpendicular passageway.

2. A pressure regulator as claimed in claim 1 including:

the aperture being pear shaped with the small end thereof being on the downstream side of the piston means.

3. A pressure regulator valve as claimed in claim 1 including:

means for stopping downstream movement of the piston means when the aperture is fully opened to the perpendicular passageway.

4. A pressure regulator as claimed in claim 3 wherein the stopping means includes:

the cylindrical hole of the valve body having an annular enlargement adjacent the perpendicular passageway;

a retainer ring mounted on the piston means portion within the annular enlargement; and the retainer ring being located to engage a downstream end of the annular enlargement when the aperture is fully opened to the perpendicular passageway.

5. A pressure regulator as claimed in claim 4 including:

the retainer ring being spaced upstream from the O-ring seal for the aperture; and a collar mounted about the piston means between the retainer ring and the O-ring seal for the aperture; and the collar being notched to receive and retain the O-ring seal for the aperture.

6. A pressure regulator as claimed in claim 5 including:

the piston means being a hollow piston head and a tubular rod;

the downstream portion of the cylindrical hole being counterbored; and the biasing means including a compression spring disposed in the counterbore between the bottom of the counterbore and the bottom of the piston head.

7. A pressure regulator as claimed in claim 6 including:

the aperture being pear shaped with the small end thereof being on the downstream side of the piston rod.

* * * * *